United States Patent [19]

Kosaka et al.

[11] Patent Number: 4,690,036

[45] Date of Patent: Sep. 1, 1987

[54] AXIAL PISTON PUMP OR MOTOR WITH MULTI POSITION SWASH PLATE

[75] Inventors: Masato Kosaka, Tokyo; Tatsu Yamazaki, Yamato, both of Japan

[73] Assignee: Kayaba Kogyo Kabushiki Kaisha, Japan

[21] Appl. No.: 838,421

[22] Filed: Feb. 28, 1986

Related U.S. Application Data

[63] Continuation of Ser. No. 689,652, Jan. 8, 1985, abandoned.

[30] Foreign Application Priority Data

Aug. 16, 1984 [JP] Japan ..... 59-170728

[51] Int. Cl.[4] ..... F01B 13/04

[52] U.S. Cl. ..... 91/506; 92/12.2; 417/222

[58] Field of Search ..... 91/487, 488, 504–507; 92/12.2; 417/222

[56] References Cited

U.S. PATENT DOCUMENTS

| | | | |
|---|---|---|---|
| 2,870,746 | 1/1959 | Keel | 91/499 X |
| 3,070,031 | 12/1962 | Puryear | 417/222 |
| 3,382,793 | 5/1968 | Gantzer | 91/499 |
| 3,479,963 | 11/1969 | Randa et al. | 91/507 |
| 3,935,796 | 2/1976 | Wood | 91/504 |
| 4,142,452 | 3/1979 | Forster | 91/506 |
| 4,581,980 | 4/1986 | Berthold | 91/506 X |

FOREIGN PATENT DOCUMENTS

| | | | |
|---|---|---|---|
| 2130514 | 12/1972 | Fed. Rep. of Germany | 91/499 |
| 2853494 | 6/1979 | Fed. Rep. of Germany | 91/506 |
| 3120154 | 12/1982 | Fed. Rep. of Germany | 417/222 |
| 1357561 | 2/1964 | France | 91/505 |
| 2312668 | 12/1976 | France | 91/499 |
| 113274 | 6/1984 | Japan | 417/222 |
| 812927 | 11/1958 | United Kingdom | 91/506 |
| 197708 | 2/1976 | U.S.S.R. | 91/499 |

*Primary Examiner*—Carlton R. Croyle
*Assistant Examiner*—Paul F. Neils
*Attorney, Agent, or Firm*—McGlew and Tuttle

[57] ABSTRACT

This invention relates to an axial piston system hydraulic pump or motor capable of being changed over by two stages and particularly preferably used as the hydraulic motor for driving vehicles such as bulldozer, shoveldozer, etc. Thus, to provide as compact as possible two step changing-over mechanism and a well-balanced operation with a relative small force, a smooth plane against which the shoe at the plunger side opposed to a swash plate abuts and a first and second abutting portions located at the opposite plane to the smooth plane to abut against a fixed portion, when the swash plate pivots about the center of pivotal movement, to regulate the angle of said smooth plane of the swash plate to two positions are formed while a drive member is disposed which pivots said swash plate about the center of the pivotal movement to displace the angle of the smooth plane to two positions. Also, preferably, a pair of the drive members are arranged in the left and right positions respectively corresponding to the high and low pressure sides of the hydraulic pump or motor.

6 Claims, 9 Drawing Figures

AXIAL PISTON PUMP OR MOTOR WITH MULTI POSITION SWASH PLATE

This application is a continuation of application Ser. No. 689,652, filed Jan. 8, 1985, now abandoned.

BACKGROUND OF THE INVENTION

This invention relates to a variable capacity type hydraulic pump or motor and particularly to an axial piston system hydraulic motor provided with an axial cylinder for driving a vehicle.

In a vehicle which requires two travel speeds (e.g. for high and low speed travelling) such as a bulldozer or shoveldozer, a hydraulic circuit for travelling is accomplished by a series or parallel circuit, combined circuit or the like, or a hydraulic motor capable of varying the capacity by two steps is used as disclosed in the U.S. Pat. Nos. 4,037,521 and 4,048,903 or any means such as a hydraulic pump capable of varying the discharge by two steps are employed.

However, when the hydraulic circuit such as series circuit, parallel circuit or combined circuit is merely used, the circuit constitution becomes complicated and a lot of labor is needed for manufacture. Also, the two step change-over type hydraulic pump and hydraulic motor disclosed in the U.S. Pat. Nos. 4,037,521 and 4,048,903 specifications are large-sized and expensive by themselves and have disadvantages in that not only a special inconvenience is caused in mounting them on the bulldozer, shoveldozer or the like, but also the price of these vehicles is heightened.

Also, in addition, in order to hold these hydraulic pumps or motors at the variable position, since a variable operation mechanism must take on a piston thrust of the hydraulic pump or motor, the thrust of the variable operation mechanism has to be designed to be extremely large and thus the strength of parts constituting the variable operation mechanism becomes so large that this urges further this type of hydraulic pump or motor to be large-scaled and expensive.

SUMMARY OF THE INVENTION

Accordingly, a main object of this invention is to provide a simple structured, economical and compact hydraulic pump or motor capable of being changed over to two high and low stages.

A further object of this invention is to provide a variable operation mechanism capable of holding stably the hydraulic pump or motor capable of being changed over to two high and low stages at the respective change-over positions.

To accomplish these objects, the hydraulic pump or motor according to this invention comprises a casing, a rotary shaft connected pivotably to the casing, a cylinder block connected to the rotary shaft, plungers slidably inserted respectively into a plurality of cylinders formed in the cylinder block, a pair of Kidney ports for selectively connecting said respective cylinders to the high or low pressure side along with the rotation of said cylinder block, shoes respectively held by said respective plungers and a swash plate slidably contacting these shoes, and is characterized in that the swash plate is provided with a smooth plane against which the shoes of the respective plungers abut and first and second abutting portions located in the surface opposite to the smooth plane and abutting against the fixed portion of the swash plate when the swash plate pivots about the center of pivotal movement so as to regulate the angle of said smooth surface of the swash plate to two positions and a drive member is disposed which is opposed to the swash plate to displace the angle of the smooth surface of the swash plate to two positions. And further, it is characterized in that a plurality of the drive members are arranged opposed to a pair of said left and right Kidney ports and these drive members are operated respectively in association with the same side Kidney ports.

DESCRIPTION OF THE PREFERRED EMBODIMENT

Hereinafter will be described an example of a variable capacity type hydraulic motor for driving a vehicle, shown in the accompanying drawings, with reference to a most preferable embodiment according to this invention. However, this invention, of course, is not always limited to such variable capacity type hydraulic motor for driving the vehicle, but also readily applies to variable capacity type hydraulic motors or variable discharge type hydraulic pumps having similar constitution used for other applications.

Figure 1:
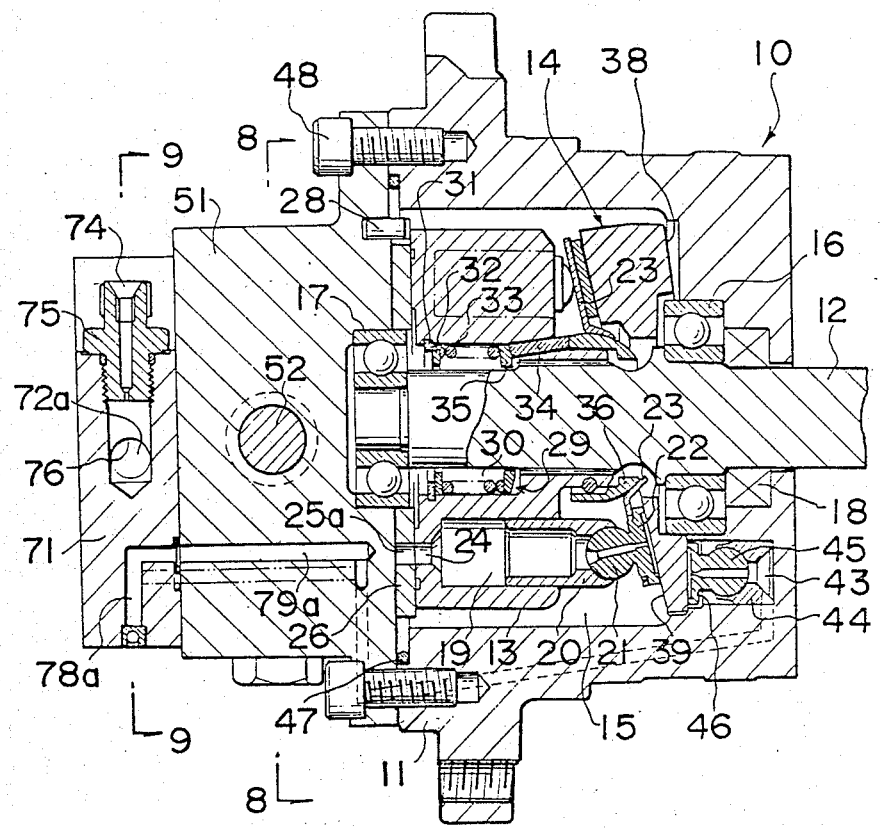
FIG. 1 is a sectional front view of a variable type hydraulic pump or motor of an embodiment according to this invention, taken along the line 1—1 in FIG. 8.

In FIG. 1 a variable capacity type hydraulic motor 10 for driving a vehicle comprises a casing 11, a rotary shaft 12 of an output member, a cylinder block 13 and a swash plate 14, and in the casing 11 are mounted a first valve body 51 having a counterbalance valve 52 incorporated and a second valve body 71 having similarly pilot control valves 72*a*, 72*b* incorporated and overlaid said valve body 51.

Said casing 11 has an inside cavity chamber 15 in which are received said cylinder block 13 and the swash plate 14. Also, the rotary shaft 12 of the output member extends through these cylinder block 13 and swash plate 14 and is disposed in the cavity chamber 15 and supported rotatably by a ball bearing 16 interposed between the casing 11 and said shaft 12 and a ball bearing 17 interposed between said shaft 12 and the first valve body 51. Further, a portion of the rotary shaft 12 at the ball bearing 16 supported side is sealed by a seal member 18 interposed between the casing 11 and said bearing 16 and extends through the casing 11 to project outside.

Said cylinder block 13 received in the cavity chamber 15 within the casing 11 is coupled in the center portion with said rotary shaft 12 of the output shaft through spline so that the cylinder block 13 is held to rotate together with the rotary shaft 12 within the cavity chamber 15. Further, for means of coupling said cylinder block 13 with said rotary shaft 12 of course can be selected any means other than said spline coupling.

Said cylinder block 13 comprises a plurality of cylinders 19 arranged concentrically and respectively receiving slidably plungers 20 therein. These plungers 20 hold, on each end projecting from the cylinder 19, a shoe 22 through an universal joint 21. And these shoes 22 are urged against said swash plate 14 through a retainer plate 23 having the respective shoes 22 fitted therein by a pressing means which will be later described.

Figure 2:
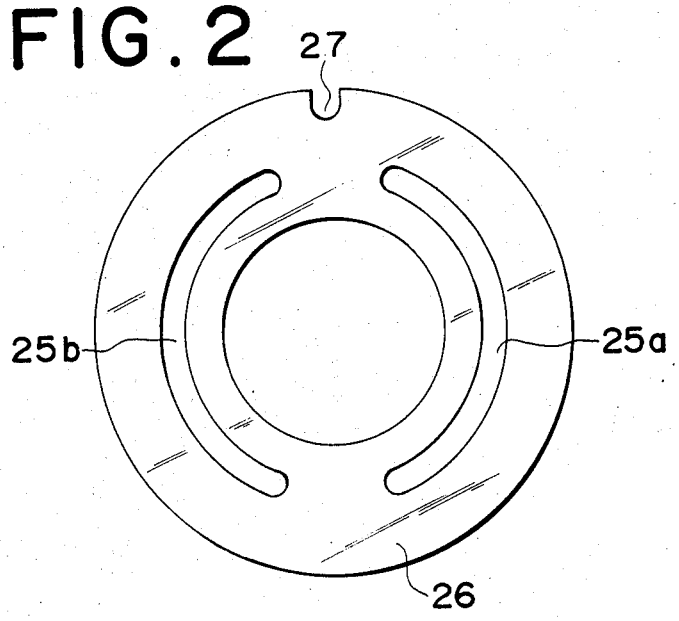
FIG. 2 is a side view of a valve plate.

The inner end of said cylinder 19 communicate with Kidney ports 25*a*, 25*b* (see FIG. 2) at the first valve body 51 side through a port 24. In this embodiment, while the Kidney or Kidney shaped ports 25*a*, 25*b* are formed in a valve plate 26 interposed between the cylinder block 13 and the first valve body 51, they may be formed directly in the first valve body 51. Further, the valve plate 26 is blocked against rotation by a notch 27 formed in the outer periphery and fitted onto a pin 28 planted in the first valve body 51.

As will be described later, one of the respective Kidney ports 25*a*, 26*b* communicates to a pressurized oil drain path when the other communicates with a pressurized oil supply path. Thus, the cylinder 19 in the cylinder block 13 opposed to the Kidney port 25*a* or 25*b* communicating to the pressurized oil supply path is supplied with pressurized oil through the port 24 to press the shoe 22 against the swash plate 14 through the plunger 20. Thus, as is well known, the cylinder block 13 receives a turning force as the reaction and this turning force is taken out to the exterior through the rotary shaft 12 of the output shaft.

In starting the hydraulic motor 10 in this case, to prevent oil leakage between the cylinder block 13 and the Kidney ports 25*a*, 25*b* and effectively give said turning force to the cylinder block 13, the cylinder block 13 is provided with a press means 29 which always presses the shoe 22 of each plunger 20 against the swash plate 14 and the cylinder block 13 against the Kidney ports 25*a*, 25*b*.

Said press means 29 is received in a proper-sized space 30 formed in a position near the central portion of the cylinder block 13 and adjacent the rotary shaft 12. In to the space 30 is provided projectingly a stopper 31 from the cylinder block 13. This stopper 31 holds one end of a spring 33 through a collar 32. The other end of the spring 33 bears against the base end of a plurality of pins 34 extending through the cylinder block 13 through the other collar 35. An end of said pin 34 bears against a spherical collar 36, and further the outer surface of the spherical collar 36 bearing against the retainer plate 23 through which the shoe 22 of each plunger 20 fitted in said retainer plate 23 is pressed against the swash plate 14.

Thus, even in starting when no-pressure condition in the cylinder 19 in the cylinder block 13 shifts to pressurized condition, the cylinder block 13 is pressed against portions of the Kidney ports 25*a*, 25*b* by the force of the spring 33 to prevent oil leakage between the cylinder block 13 and the Kidney ports 25*a*, 25*b*, while blocking the separation of each shoe 22 in the plunger 20 from the swash plate (14) to give a effective turning force to the cylinder block 13 so that this turning force can be taken out of the rotary shaft 12 to the exterior.

Figure 3:
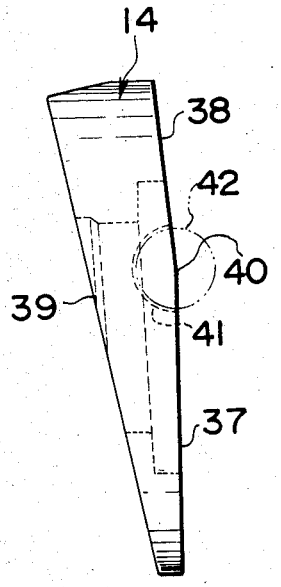
FIG. 3 is a front view of a swash plate.
Figure 4:
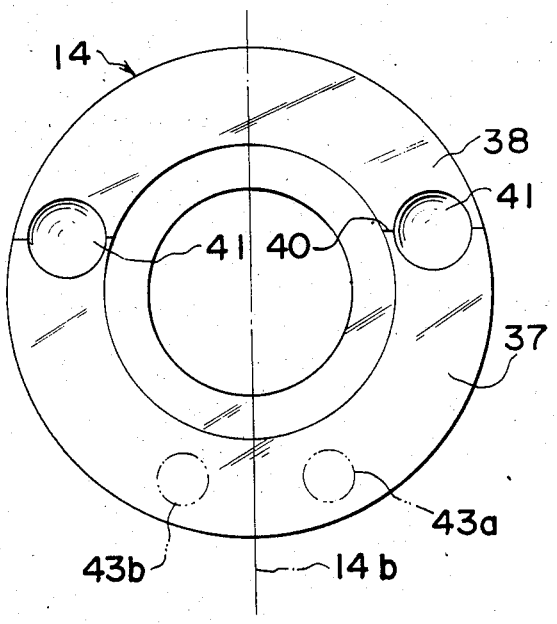
FIG. 4 is a side view of same swash plate.

The swash plate 14 of the most important portion for this invention, as seen in FIGS. 1, 3 and 4, is located at the back side opposed to the inside face of the casing 11 and provided with first and second abutting portions or planes 37, 38 selectively abutting against the inside face of the casing 11 in two positions. This inside face of casing 11 is perpendicular to the axis of shaft 12. Also, the swash plate 14 is formed at the retainer plate 23 side with a smooth slant surface 39 against which slidably bears the shoe 22 of each plunger 20.

In the case of this embodiment, said first and second abutting portions 37, 38 provide respectively two divided planes having angles different from each other at the back face of the swash plate 14 such that said swash plate 14 pivots about the border line 40 between these two planes relative to the casing 11.

Thus, in this embodiment, since the back face of the swash plate 14 is divided into two planes having angles different from each other such that the swash plate 14 pivots about the border line 40 between these planes, a mechanism is needed to hold the swash plate 14 at a predetermined position relative to the casing 11. Thus, as seen in FIG. 3 and 4, the swash plate 14 is formed on the backface side with two symmetrical semi-spherical ball holes or recesses 41 arranged on said border line 40, and the casing 11 is formed on the inside face with ball holes or recesses (not shown) opposed to these holes 41 and shaped to the remaining semispherical surface. And a ball 42 is interposed with a extremely slight clearance between the ball hole 41 at the swash plate 14 side and the ball hole at the casing 11 side so that the swash plate 14 is located relative to the casing 11 by the ball 42.

Figure 5:
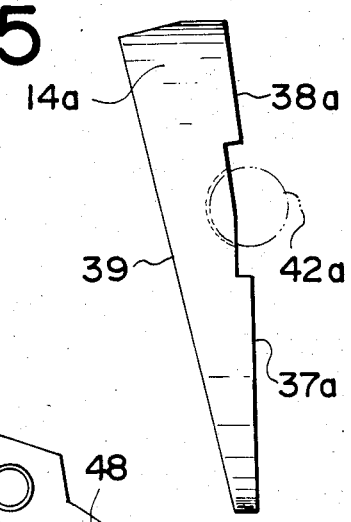
FIG. 5 is a front view showing another embodiment of the swash plate.

Further, the first and second abutting portions 37, 38 of said swash plate 14 may not divide the back face of the swash plate 14 to form two planes having angles different from each other. For example as seen in FIG. 5, a swash plate 14*a* may be constituted such that partially constituted first and second abutting portions 37*a*, 38*a* abut selectively against the inside face of the casing 11. Also, the center of pivotal movement of the swash plate 14 formed of the border line 40, similarly as shown in FIG. 5, may be omitted by utilizing a well-known cylindrical roller bearing or spherical bearing 42*a* or the like serving also as a swash plate 14*a* locating mechanism. And particularly in this case, these cylindrical roller bearing or spherical bearing 42*a* can serve also as said swash plate 14 locating mechanism.

Again in FIG. 1, the casing 11 is provided with a control cylinder 43 of a drive member for the swash plate 14. This control cylinder 43 is provided in the interior with a slidable piston 44, and on the end of the piston 44 is mounted a shoe 46 through an universal joint 45. While only one control cylinder 43 may be provided opposed to the lower portion of the center line 14*b* of the swash plate 14, in FIG. 4 it is preferably constituted from a pair of control cylinders 43*a*, 43*b* like this embodiment which are located in the eccentric position of the swash plate 14 shown by the chain line in FIG. 4 and arranged opposedly symmetrically at both left and right sides of the center line 14*b* interconnecting the upper and lower ends of the swash plate 14.

Figure 6:
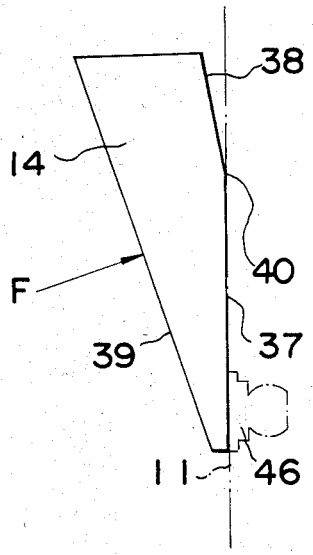
FIG. 6 and 7 are explanatory illustrations showing the balance requirement in two motional positions of the swash plate.

Also, a point at which the shoe 46 in the control cylinder 43 exerts a force to the swash plate 14 is positioned relative to the center 40 of pivotal movement of said swash plate 14 such that, as seen in FIG. 6, said point and said center are located respectively above and below a working point. At this working point, a resultant force F is applied. This resultant force F is made up of a force to push out the plunger 20 with a hydraulic force exerted in the cylinder 19 within the cylinder block 13 and a force of the spring 33 of the press means 29 acting on the swash plate 14. Thus, by supplying pilot oil pressure to the control cylinder 43 or extracting it to the drain side can be pivoted the swash plate 14 as seen in FIG. 6 and 7.

Figure 7:
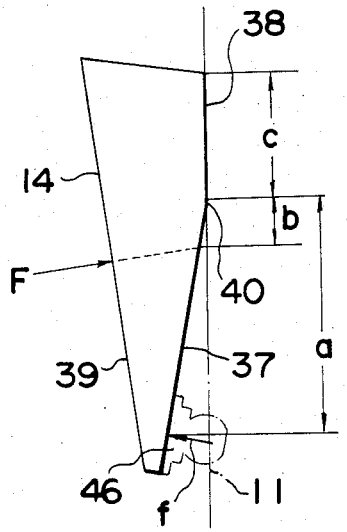

That is, when the pilot oil pressure does not act on the control cylinder 43, in other words, when the control cylinder 43 has low pressure, the swash plate 14 receives counterclockwise turning force about the center 40 of pivotal movement of the swash plate 14 from said resultant force F, and, as shown in FIG. 6, the swash plate 14 takes the position in which the first abutting portion 37 is pressed against the inside face of the casing 11, that is, the low speed drive condition in a motor and the high speed discharge condition in a pump. On the other hand, when pressurized oil is sent into the control cylinder 43, a force f caused by the control cylinder 43 acts on the swash plate 14 through the shoe 48. And in this case, when the distance between the working point of the force f caused by said control cylinder 43 and the center 40 of pivotal movement of the swash plate 14 is designated by a the distance between the working point of said resultant force F at the cylinder lock 13 side and said center 40 designated by b, the distance between said center 40 and the upper end of the swash plate 14 designated by c, and the force f is selected to establish the following relational formula;

$$\frac{b}{a} \times F < f < \frac{b+c}{a+c} \times F,$$

the swash plate 14 takes the position at which the second abutting portion 38 is pressed against the inside face of the casing 11 as shown in FIG. 7, that is, the high speed drive condition in the motor and the low speed discharge condition in the pump to be stabilized.

Further, in this embodiment, said control cylinder 43 is disposed opposed to the lower portion of the first abutting portion 37 of the swash plate 14 so that it is constituted to push the swash plate 14 through the shoe 46. Reversely, the control cylinder 43 for example may be disposed opposed to the lower portion of the inclined surface 39 of the swash plate 14 or opposed to the upper portion of the second abutting portion 38 of the swash plate 14 so that the swash plate 14 is constituted to be operatively pulled by the control cylinder 43.

In FIG. 1, a first valve body 51 incorporating a counterbalance valve 52 and sandwiching the seal member 47 is mounted on the open end side of the casing 11 by a plurality of bolts 48 to seal that portion.

Figure 8:
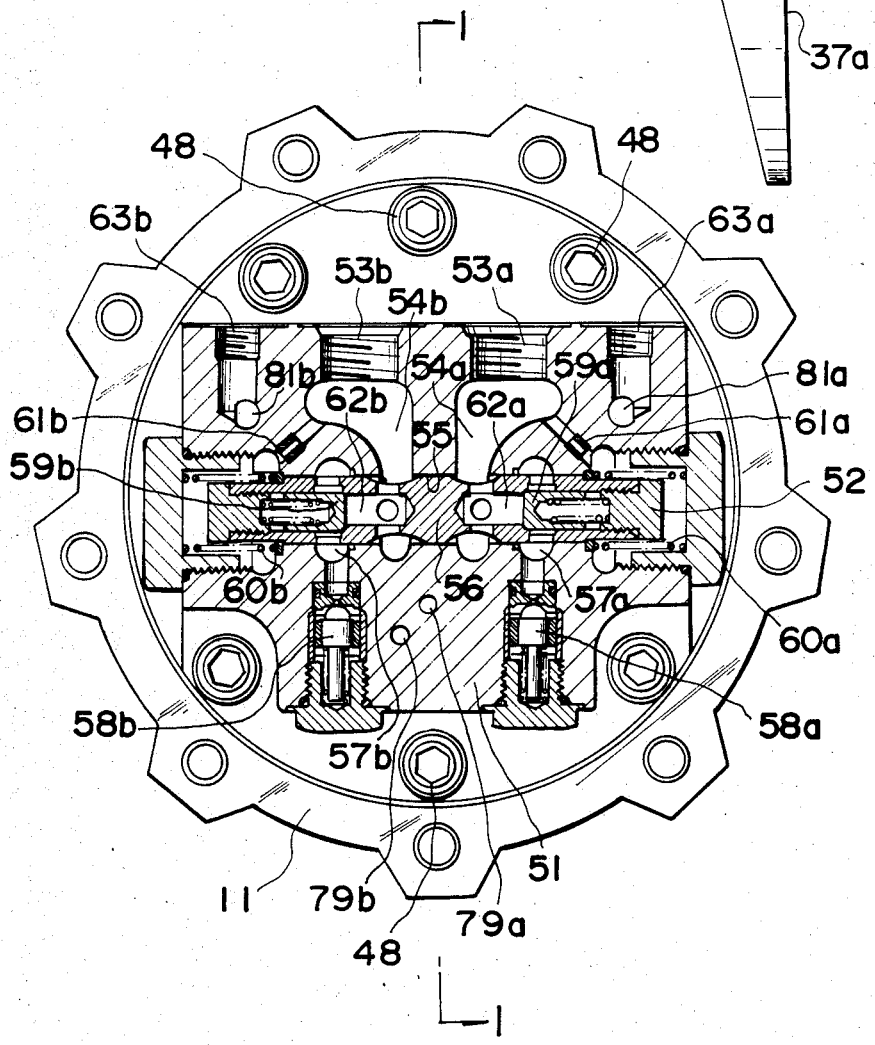
FIG. 8 is a longitudinal sectional side view of the hydraulic pump taken along the line 8—8 in FIG. 1.

As seen in FIG. 8, said first valve body 51 has two ports 53*a*, 53*b* which communicate through paths 54*a*, 54*b* with a valve hole 55 in the counter-balance valve 52, and a valve body 58 of the counter-balance valve 52 is slidably received in the valve hole 55. Also, paths 57*a*, 57*b* provided on the way of the valve hole 55 communicate respectively with relief valves 58*a*, 58*b*, while communicating respectively with the Kidney ports 25*a*, 25*b* at the casing 11 side through a path not shown and two pilot control valves 72*a*, 72*b* sides in a second valve body 71 which will be later described.

Said counter-balance valve 52, as is well known, is provided in the interior with check valves 59*a*, 59*b* and when held at the neutral position by center springs 60*a*, 60*b* arranged usually left and right of said valve 52, blocks communication between said paths 57*a*, 57*b* and paths 53*a*, 53*b* through the paths 54*a*, 54*b*. Also when pressurized oil is introduced into either one of the ports 53*a*, 53*b* under such condition, the pressurized oil is conducted form limit path 61*a* or 61*b* at that side to the end face of that side in the valve body 56 to change over the valve body 56 left or right so that the pressurized oil is allowed to flow from the port 53*a* or 53*b* through the path 54*a* or 54*b* and paths 62*a* or 62*b* provided in the valve body 56 to the path 57*a* or 57*b* after opening a check valve 59*a* or 59*b*, while the paths 57*b* and 54*b* or paths 57*a* and 54*a* communicate with each other to allow return working oil from the port 53*b* or 53*a* to flow.

Figure 9:
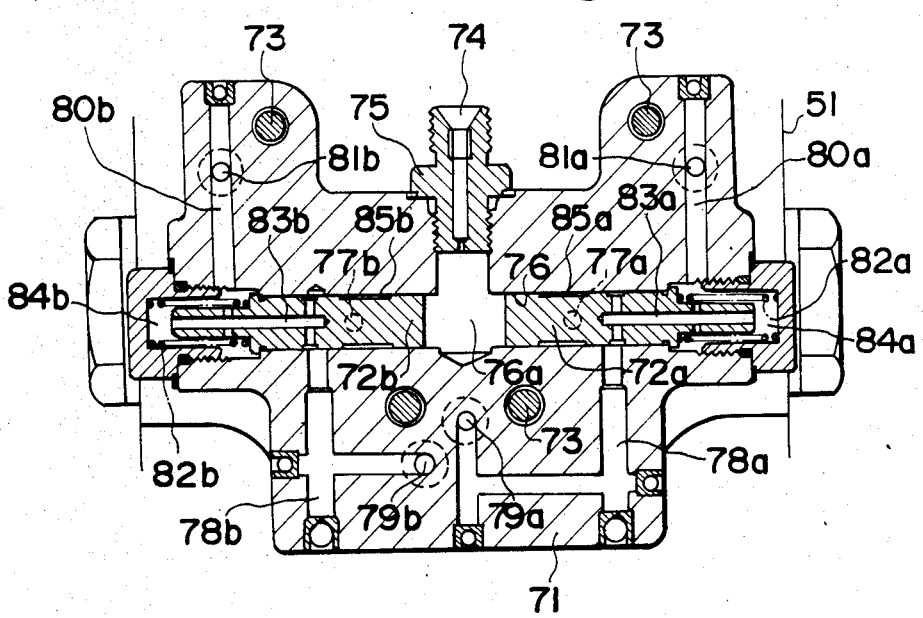
FIG. 9 is an enlarged longitudinal sectional view of same taken along the line 9—9 in FIG. 1.

In FIGS. 1 and 9, a second valve body 71 incorporating pilot control valves 72*a*, 72*b* is mounted on the second valve body 51 by a plurality of bolts 73.

Said second valve body 71 comprises a port plug 75 having a pilot port 74 which communicates with a valve hole 76 formed in the second valve body 71. Further, the valve hole 76 communicates with a pair of left and right paths 57*a*, 57*b* in the counterbalance valve 52 of said first valve body 51 through a pair of left and right paths 77*a*, 77*b*. Similarly, the valve hole 76 also communicates with a pair of left and right control cylinders 43*a*, 43*b* at the casing 11 side through a pair of left and right paths 78*a*, 78*b* and paths 79*a*, 79*b* extending through the casing 11 and the first valve body 51. Also, the valve hole 76 communicates with the return ports 63*a*, 63*b* formed in the first valve body 51 through paths 81*a*, 81*b* formed from paths 80*a*, 80*b* to the first valve body 51.

In said valve hole 76 is received slidably a pair of left and right pilot control valves 72*a*, 72*b*. Usually these pilot control valves 72*a*, 72*b* close the paths 77*a*, 77*b* with forces of springs 82*a*, 82*b*, while holding the paths 78*a*, 78*b* at such a position as they communicate with paths 70*a*, 80*b* through through holes 83*a*, 83*b* provided in the pilot control valve 72*a*, 72*b* and spring chambers 84*a*, 84*b*.

On the other hand, when the pilot pressure is introduced from the pilot port 74 into the valve hole 76, the pilot pressure acts on the end face of both pilot control valves 72*a*, 72*b* which interrupt communication between the paths 78*a*, 78*b* and the paths 80*a*, 80*b* provided by the through holes 83*a*, 83*b*, while holding the paths 78*a*, 78*b* at such a change-over position as the paths 78*a*, 78*b* communicate with the path 77*a*, 77*b* sides through annular grooves 85*a*, 85*b* formed on the outer periphery of the pilot control valves 72*a*, 72*b*.

Further, in this embodiment, the path 77*a* communicating with the path 57*a* at the said counter-balance valve 52 side communicates with the control cylinder 43*a* at the same side in the casing 11 side through the paths 78*a*, 79*a* controlled by the pilot control valve 72*a* to communicate with each other, and the path 77*b* communicating with the path 57*b* at the counterbalance valve 52 side communicates with the control cylinder 43*b* at the same side in the casing 11 side through the paths 78*b*, 79*b* controlled by the pilot control valve 72 to communicate with each other.

Thus, the variable capacity type hydraulic motor 10 thru constituted for driving a vehicle is operated in the following manner;

When pressurized oil is supplied from the port 53*a* in the first valve body 51 shown in FIG. 8, it acts on the right end of the valve body 56 in the counterbalance valve 52 from the path 54*a* through the limit path 61*a* to change over the valve body 56 leftward. Also at the same time, the pressurized oil enters the path 57*a* from the path 54*a* through the path 62*a*, while pushing and opening the check valve 59*a* and further tends to enter the path 78*a* through the path 77*a* in the second valve body 71 shown in FIG. 9. However, since communication between the path 77*a* and the path 78*a* is interrupted by the pilot control valve 72*a*, the pressurized oil entering said path 57*a* flows into the Kidney port 25*a* at the casing 11 side through a path (not shown).

On the other hand, the Kidney port 25*b* at the opposite side communicates to the path 57*b* in the first valve body 51 through a path not shown. Since the path 57*b* communicates with the path 54*b* through the change-over of the valve body 56 in said counterbalance valve 52, the Kidney port 25*b* communicates with the port 53*b* through the path 57*b*. Thus, when the port 53*b* is connected to the drain side, as is well known, the cylinder block 13 in the casing 11 is supplied with pressurized oil from the Kidney port 25*a* to the predetermined cylinder 19, while draining return oil to the other Kidney port 25*b* side to rotate the rotary shaft 12 of the output shaft in the forward rotation side.

And then, when pilot oil having a predetermined pressure pilot oil is introduced from the pilot port 74 in the second valve body 71 shown in FIG. 9, this pilot pressurized oil acts on the respective end faces of the pilot control valves 72*a*, 72*b* from the chamber 76*a* in the valve hole 76 to change over these pilot control valve 72*a*, 72*b* left and right against the springs 82*a*, 82*b*.

Thus, while the paths 78*a*, 78*b* has heretofore communicated with the return ports 63*a*, 63*b* in the first valve body 51 from the through holes 83*a*, 83*b* in the pilot control valves 72*a*, 72*b* through the spring chambers 84*a*, 84*b*, the paths 80*a*, 80*b* and the paths 81*a*, 81*b*, the paths 78*a*, 78*b* now communicate with the paths 77*a*, 77*b* through the annular grooves 85*a*, 85*b* in the pilot control valves 72*a*, 72*b*.

Thus, in the control cylinder 43*a* in the casing 11, a portion of pressurized oil flowing into the Kidney port 25*a* acts on the control cylinder 43*a* from the path 57*a* through the path 77*a*, the annular groove 85*a* in the pilot control valve 72*a*, the path 78*a* and the path 79*a*, and the back pressure at the return oil side in the Kidney port 25*b* acts on the another control cylinder 43*b* through the path 77*b*, the annular groove 85*b* in the pilot control valve 72*b*, the path 78*b* and the path 79*b*.

Thus, these control cylinders 43*a*, 43*b* push the pistons 44*a*, 44*b* through pressurized oil and back pressure at the return side respectively acting on said control cylinders 43*a*, 43*b* and the swash plate 14 through the shoes 46*a*, 46*b* so that the swash plate 14 holds the condition that the second abutting portion 38 engages the inside face of the casing 11 to hold the hydraulic motor 10 under the high speed control condition.

Also, when the pilot port 74 is connected to the drain side from such condition, the pilot control valves 72*a*, 72*b* are both changed over inward by the stability of the springs 82*a*, 82*b* so that the paths 78*a*, 78*b* communicate with the return ports 63*a*, 63*b* from the through holes 83*a*, 83*b* through the spring chambers 82*a*, 82*b*, the paths 80*a*, 80*b* and the path 81*a*, 81*b*. Thus, the swash plate 14 is pushed by the plunger 20 in the cylinder block 13 opposed to the Kidney port 25*a* supplied with pressurized oil through the corresponding shoe 22 so that the first abutting portion 37 now engages the inside face of the casing 11 to hold the hydraulic motor 10 under the low speed control condition. Also, reversely when the pressurized oil is supplied from the port 53 side while the port 53*a* is connected to the drain side, the flow of the pressurized oil now is reversed to the above case so that the cylinder block 13 is rotated to the backward rotation side together with the rotary shaft 12 and it is apparent that in this case the hydraulic motor 10 is supplied with the pilot oil pressure from the pilot port 74 to be put under the high speed control condition or the pilot port 74 is connected to the drain side so that the hydraulic motor 10 can be changed over to the low speed control condition. Further, since these actions can be easily understood by those skilled in the art on the basis of the above description, the detailed description of these actions is omitted here.

Thus, according to this invention, a hydraulic motor capable of being changed over to two high and low stages can be constituted very compact with high efficiency as well as even a discharge changing-over system hydraulic pump, if necessary, can be also made compact, compared with prior ones.

Also, since, in changing-over the two high and low stages, high pressure oil acts on the control cylinder at the side corresponding to the Kidney port on which the high pressure oil acts, and the back pressure at the return side is adapted to act on the control cylinder at the side opposed to the Kidney port on the return side on which the back pressure acts, in starting in a cold place having relative high back pressure for example, the degradation of the balancing condition of the swash plate put under the low speed control condition by the effect of theback pressure and the dispersion of performance as the hydraulic motor are prevented so that this hydraulic pump serves to maintain always the hydraulic motor under the satisfactory condition.

What is claimed is:

1. A hydraulic pump or motor comprising a casing having a cavity therein with an inside face, a rotary shaft pivotally mounted to said casing for rotation in said cavity, said shaft having a rotation axis and said inside face of said casing extending perpendicularly to said rotation axis, a cylinder block connected to said rotary shaft for rotation therewith in said cavity, said cylinder block having a plurality of cylinders, a plunger slidably inserted into each of said cylinders of said cylinder block, a pair of kidney shaped ports extending in said casing and communicating with said cavity, one of said kidney shaped ports forming a low pressure side port and the other of said kidney shaped ports forming a high pressure side port, said cylinder block being engaged with said pair of kidney shaped ports and said ports communicating respectively with said cylinders as said cylinder block rotates with rotation of said rotary shaft, a sliding shoe connected to each plunger, and a swash plate disposed in said cavity and having a smooth slant surface on which each shoe of each plunger is slidably engaged, for transmitting a resultant force at a working point on said swash plate, said swash plate having first and second abutting planes on a side opposite from said slant surface, said planes lying in mutually different angles and meeting each other at a border line, said swash plate being non-rotatably and pivotally mounted in said cavity and having two pivotal positions, one position with one of said planes in engagement with said inside face of said casing and the other position with the other of said planes engaged with said inside face with the other of said planes engaged with said inside face of said casing, sais swash plate having a pair of semicircular recesses lying on said border line and defined in said planes on opposite sides of said shaft, said casing having a pair of semicircular recesses in said inside face aligned respectively with said pair of semicircular recesses of said swash plate, a ball positioned in each of said pair of aligned recesses for pivoting of said swash plate between its positions, said border line engaged against said inside face of said casing to form a fulcrum for pivoting of said swash plate, a pair of drive cylinders with drive pistons therein, arranged in said casing on opposite sides of and at equal distances from a dividing plane containing said rotation axis for said rotary shaft and extending perpendicular to said border line, each ball in said aligned semicircular recesses lying on opposite sides of said dividing plane, said casing having passages therein for communicating each drive cylinder with one of said pair of kidney shaped ports which is located on the same side of said dividing plane as said drive cylinder, said drive cylinders being positioned eccentrically with respect to said rotation axis and said swash plate, and each drive piston being engaged against one of said abutting planes at pressure points with said working point being between said fulcrum and said pressure points and whereby low pressure is exerted on one of said drive cylinders and on cylinders of said cylinder block which are in communication with said low pressure side port and, high pressure is exerted on said drive cylinder and said cylinders of said cylinder block which are in communication with said high pressure side port to compensate forces exerted on opposite sides of said swash plate.

2. A hydraulic pump or motor according to claim 1 wherein said border line between said first and second abutting plane is on one side of said rotation axis, said drive pistons being engaged with one of said abutting planes on an opposite side of said rotation axis.

3. A hydraulic pump or motor according to claim 1 wherein each ball is received in its semi-circular recesses with clearance so that a firm engagement is established between said border line and said face of said casing to form a fulcrum for pivoting of said swash plate.

4. A hydraulic pump or motor according to claim 1, including an odd number of cylinders with plungers in said cylinder block.

5. A hydraulic pump or motor according to claim 1 wherein each ball is positioned at equal spacing and on opposite sides of said dividing plane and at a distance from said dividing plane greater than the distance between said dividing plane and each one of said drive cylinders.

6. A hydraulic pump or motor according to claim 5 wherein each ball is received in its semi-circular recesses with clearance so that a firm engagement is established between said border line and said face of said casing to form a fulcrum for pivoting of said swash plate.

* * * * *